United States Patent [19]

Davila et al.

[11] 3,993,531

[45] Nov. 23, 1976

[54] DEVICE FOR WRAPPING INSULATION TAPE ABOUT AN ELONGATE CONDUCTOR

[75] Inventors: Octaviano Aguirre Dävila; Lennart Johan Yngve Johansson Hellström, both of Mexico City, Mexico

[73] Assignee: Telefonaktiebolaget L M Ericsson, Stockholm, Sweden

[22] Filed: Oct. 23, 1975

[21] Appl. No.: 625,255

Related U.S. Application Data

[63] Continuation-in-part of Ser. No. 435,242, Jan. 21, 1974, abandoned.

[30] Foreign Application Priority Data

Jan. 19, 1973 Mexico ..... 141037

[52] U.S. Cl. ..... 156/428; 118/410; 156/53; 156/459; 156/578

[51] Int. Cl.[2] ..... H01B 13/26; B65H 81/06

[58] Field of Search ..... 156/428, 459, 578, 53, 156/56, 51, 52, 187, 191, 192, 195, 425, 431, 392, 429, 430, 578; 118/410, 411, 412; 242/7.22, 7.23

[56] References Cited

UNITED STATES PATENTS

| | | | |
|---|---|---|---|
| 1,865,415 | 6/1932 | Wodtke | 156/56 |
| 2,377,608 | 6/1945 | Bronson | 156/429 |
| 2,805,180 | 9/1957 | Burr | 156/428 |
| 3,000,167 | 9/1961 | Pierce, Jr. | 242/7.23 |
| 3,332,814 | 7/1967 | Yoshimura et al. | 156/56 |
| 3,401,073 | 9/1968 | Wood | 156/429 |
| 3,404,050 | 10/1968 | Gill | 156/53 |
| 3,700,520 | 10/1972 | Hielema | 156/195 |

*Primary Examiner*—William A. Powell
*Assistant Examiner*—Michael W. Ball
*Attorney, Agent, or Firm*—Hane, Sullivan & Spiecens

[57] ABSTRACT

A rotatable assembly is rotatably mounted on a stationary assembly. The stationary assembly guides a conductor wire, or the like, to a wrapping station, the rotatable assembly applying glue or other adhesive to a portion of a wrapping tape which is wrapped around the conductor wire at the wrapping station. The glue is applied to the wrapping tape by supplying it to a receptacle in the rotatable assembly, from which it is forced out through a hole by centrifugal force. The receptacle is of conical shape so that the centrifugal force acting on the glue will have a component thereof forcing the glue up toward the hole, and out therefrom.

15 Claims, 2 Drawing Figures

DEVICE FOR WRAPPING INSULATION TAPE ABOUT AN ELONGATE CONDUCTOR

This application is a continuation-in-part application based on co-pending application Ser. No. 435,242 filed Jan. 21, 1974, now abandoned.

The present invention relates to a device for wrapping or winding insulation tape about an elongate conductor, such as electric cable, and particularly to a device for winding the tape with overlap and securing the overlapping tape windings in position.

BACKGROUND

There are known tape winding devices of the general type above-referred to in which a conductor wire to be insulated is guided through the center axis of a spool or coil of insulation tape. As the conductor advances, the tape is spirally wound about the conductor so that the conductor is completely coated. A die at the point where the tape and the conductor are joined serves to insure the joining of conductor wire and tape. The ratio between the longitudinal speed of the conductor wire and the rotational feed of the insulation tape is constant and it is selected to maintain overlap between the turns of the tape in order to avoid that the conductor is exposed at some areas.

However, it often occurs that when wrapping conductors insulated in the above-described manner, the tape loosens or slips at points where the conductor is bent, thus exposing the metal conductor and thereby causing contact problems in circuits connected to those conductors. In order to avoid this type of failure, several attempts have been made to glue overlapping portions of the insulating tape to each other to prevent exposure of wire portions by slipping or loosening of tape. One of these prior art modes consists of applying the glue directly to the conductor so that when joined to the insulating tape the latter is fixed to the former. However, when using this mode it has been found that sometimes the glue corrodes the conductor, thereby causing a change in the physical and chemical characteristics thereof. It has also been found that with telephone cables this manner of applying a binder causes very high capacitances between the conductors which damage the characteristics of the transmission. Another known attempt to solve the problem consists of applying binder to the insulating tape when the same has been wound about the conductor. This entails the problem that the wound layers of tape stick to each other when they are joined on the wind-up spool for the finished conductor cable due to the fact that the binder will not dry with the chosen speed and the short distance from the point where the conductor and the tape are joined to the wind-up spool. This drawback can, of course, be avoided by using a quick drying binder or by the application of heat or taking other measures to obtain a fast drying, but this complicates the operation and increases the production costs.

THE INVENTION

The invention provides a novel and improved tape winding device which automatically applies binder or adhesive only to the tape portions that overlap when and while it is spirally wound upon the advancing wire conductor. As a result, the adhesive is not in direct contact with the conductor or the exterior surface portions of the tape.

BRIEF DESCRIPTION OF THE INVENTION

In the accompanying drawing, a preferred embodiment of a tape winding device according to the invention is shown by way of illustration and not by way of limitation.

In the drawing:

FIG. 1 is an elevational sectional view of the applicator in a tape winding device according to the invention; and FIG. 2 is a diagrammatic elevational view of the tape winding device including an applicator according to FIG. 1.

DETAILED DESCRIPTION OF THE DRAWING

Figure 1:
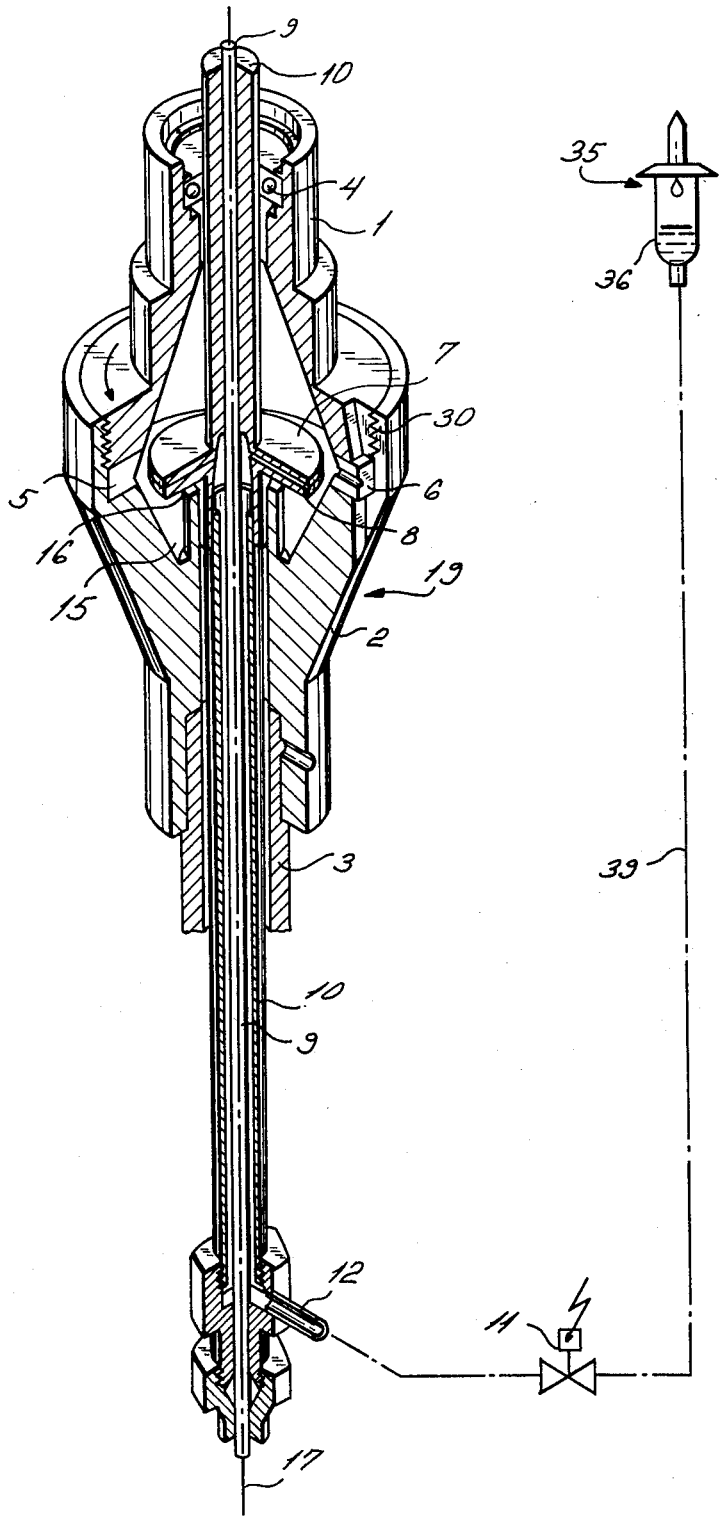

Referring now to the figures more in detail, and first to FIG. 1, the applicator shown in this figure is generally designated by reference numeral 19. It comprises an operationally movable and an operationally stationary assembly. The movable assembly is composed of two parts 1 and 2 releasably fastened to each other, for instance by screw threads 30. The two parts when joined define therein a space the lower half of which forms a receptacle 15 which is conically shaped for a purpose which will be explained hereinafter. Bearing 4 in the upper part 1 is supported by the pipe 10 to which a disc 7 is fastened, and the lower part 2 is guided by and rotatable about a hollow tube 10.

A tape guiding and glue positioning ring 5 is interposed between the two parts 1 and 2. The ring is suitably made of a non-corrosive and abrasion-resistant material, such as molybdene sulphide ($MoS_2$) with nylon known under the trademark NYLATRON or stainless steel preferably clad on the glue wetted inner surface side with polytetrafluoroethylene, known under the trademark TEFLON. The ring includes a radially extending hole 6 through which a binder such as a flowable adhesive for adhering the overlapping winding portions of the tape to each other can flow out during the operation of the tape winding device, as will be more fully explained hereinafter.

The stationary assembly comprises the disc 7 including one or more radially directed and circumferentially spaced outlet holes 8 (only one of the holes being visible). This disc is supplied with adhesive via a pipe 10 to which in turn adhesive is supplied through a feeding tube 12. The flow of adhesive through tube 12 and thus through the annular section between the pipe 9 and the pipe 10 can be controlled by a valve 11. Pipe 10 is disposed within hollow tube 3 which accommodates a second pipe 9 which serves as guide for the conductor about which the insulation tape is to be wound, as will be more fully described in connection with FIG. 2.

Figure 2:
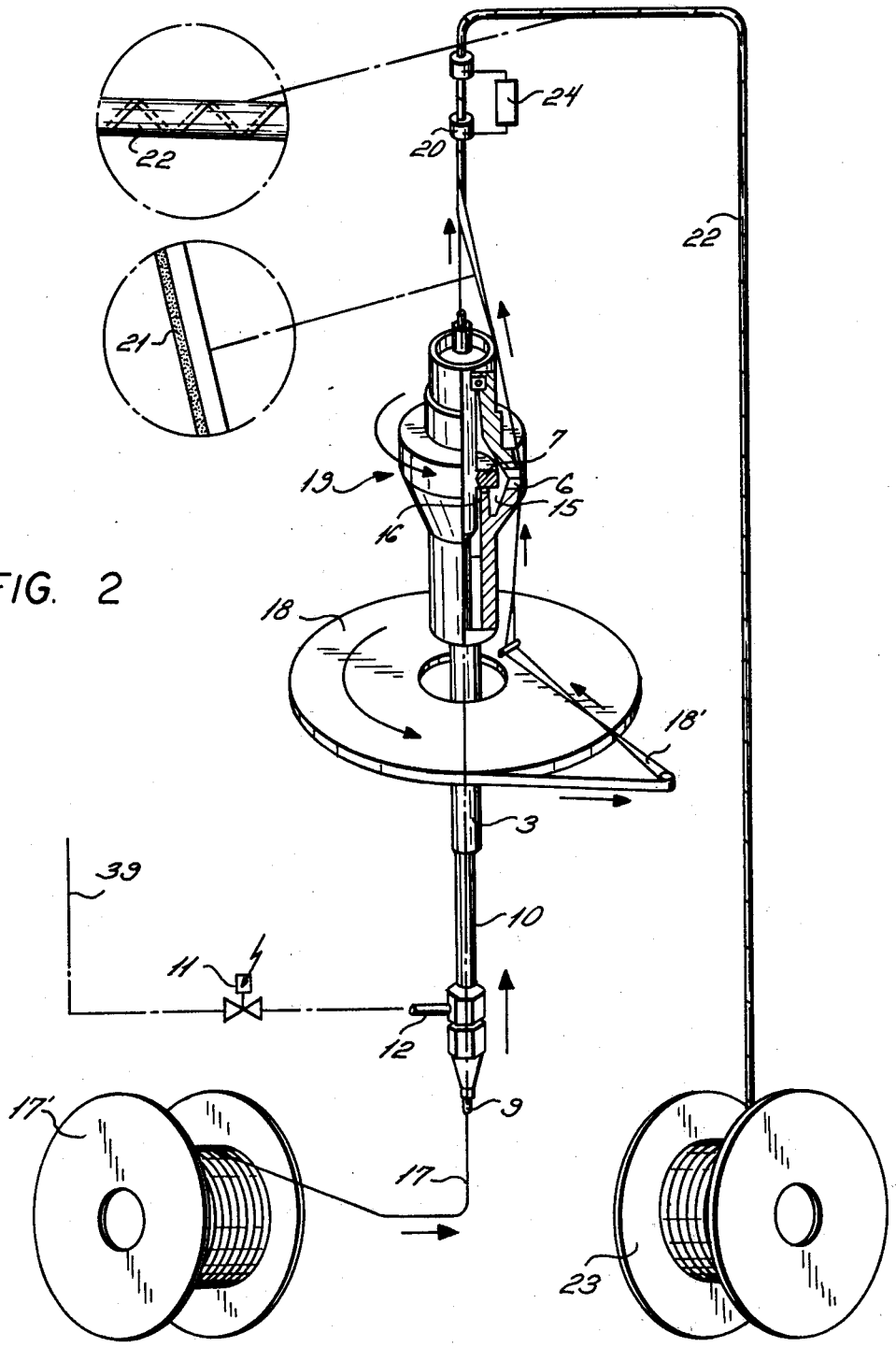

Referring now to FIG. 2, this figure shows in addition to applicator 19 a supply roller or coil 17' from which conductor wire 17 is drawn. There is further provided a pad or spool 18 for supplying insulation tape 18' to be wrapped about wire 17 and a second coil or roller 23 for winding up the wrapped and thus finished conductor wire, as shown diagrammatically at 22 in its finished condition. There is further provided a forming and calibrating die 20 of conventional design for wrapping the tape about conductor wire 17 and a sensing device 24 of conventional design for sensing whether tape has been provided with glue continuously. There is shown on an enlarged scale the desired location of the glue strip 21 and the finished tape 22.

Let it now be assumed that the tape winding device is set up for operation and that operation is started. Conductor wire 17 is withdrawn from the supply coil 17' in the direction indicated by an arrow and it is pulled within pipe 9 toward and past the applicator as indicated by arrows. The applicator parts 1 and 2 are rotated in the direction of the respective arrow. When the insulation tape has passed the applicator, it is wrapped about conductor wire 17 and fed to the die 20.

Valve 11 opens when operation is started, and pump means pump adhesive from a suitable supply (not shown) through the annular section between pipe 9 and pipe 10 at a predetermined pumping pressure. The adhesive can be fed also by means of controlled hydrostatic pressure. The adhesive thus pumped or hydrostatically fed into the applicator is discharged within the space formed by rotary applicator parts 1 and 2 and more specifically up to the level of the openings in the disc 7. The adhesive will flow through openings 8 into receptacle 15. Due to the conical wall shape of this receptacle, the adhesive is lifted by the centrifugal force acting upon it until it reaches the level of a channel or opening 16 which opens at the outside of the applicator, and more particularly, into the path along which the tape is guided by the ring 5 while passing over the applicator. The tape is guided by a cut-out in the two parts 1 and 2, while the ring 5 is turnable relative to the cut-out so that by turning the ring it is possible to place the glue strip at a desired distance from the edge of the tape.

The rotation of the applicator, the feeding speed of the conductor wire through the applicator, and the pump pressure with which the adhesive is supplied to the applicator are so correlated that the tape always passes over the same point of the applicator. Hence, the adhesive will be applied to the tape always at the same distance from the tape edge, this distance being selected so that the glue will be applied to the overlap area of the tape and thus be sealed to the underlying area of the tape without any glue leakage onto the outer surface of the insulated wire when the tape is wound about the conductor wire.

The apparatus is fed with glue from a drop-equipment 35, as shown in FIG. 1, with a constant level of glue contained in a beaker 36, or the like. The number and rate of glue drops entering into the beaker 36 is controlled by any known means so that it is possible to adjust the amount of glue supplied to the applicator via the valve 11 and tube 12. By the choice of a proper rate of drops into the beaker 36, the amount of glue supplied to the applicator only slightly exceeds the rate of usage of the glue, thereby avoiding an overflowing of the glue in the receptacle 15. The drop-equipment 35 is so placed relative to the disc 7 that the height of the column 39 of glue is adequate to provide a proper supply of glue to the applicator 19.

The principal advantages of a winding device for applying adhesive to insulation tape in the manner it is effected by a winding device according to the invention are as follows:

a. The function of the device assures that there are no gaps left in the coverage of the conductor as obtained by the insulation tape thereby avoiding exposed portions of current carrying conductor wire.

b. As with a device according to the invention, there is no direct contact between adhesive and the conductor wire to be coated; and stickiness on the outside of the insulated conductor wire and contamination of the conductor wire itself are avoided.

c. Application of tight and reliable insulation of conductor wire and avoidance of the presence of any adhesive on the outside of the tape results, in the telecommunication industry and particularly when telephone cables are to be insulated, in higher productivity as with tape winding devices now known there is an uneconomically high percentage of failures of installations due to insufficiently insulated wire portions.

What is claimed is:

1. An apparatus for gluing a wrapping tape on an elongate article comprising: means for continuously feeding an elongate article through tubular means; a stationary assembly coaxial with said tubular means; a rotatable assembly rotatable about said stationary assembly; means for rotatably mounting said rotatable assembly on said stationary assembly; and means for supplying glue or other adhesive to said stationary assembly, said stationary assembly having means for feeding the adhesive to said rotatable assembly, said rotatable assembly having means for receiving the adhesive from said stationary means and having means for coating a strip of the adhesive onto a portion of a wrapping tape and rotatable means for wrapping the coated tape onto said elongate article.

2. The apparatus according to claim 1 wherein said rotatable assembly comprises a first part having a first and second end mounted concentrically about said stationary assembly, and a second part having a first end fixedly connected to said second end of said first part and mounted concentrically about said stationary assembly, said second part extending along said stationary portion from said second end of said first part.

3. The apparatus according to claim 2 wherein said means for rotatably mounting said rotatable assembly about said stationary assembly comprises bearings mounted about said stationary assembly near said first end of said first part.

4. The apparatus according to claim 1 wherein said stationary assembly comprises a first tube extending longitudinally through said rotatable assembly, and a second tube mounted coaxial within said first tube for guiding the article there along, said first and second tubes forming an annular channel therebetween along the length thereof.

5. The apparatus according to claim 4 wherein said means for feeding the adhesive comprises an inlet tube connecting said means for supplying the adhesive with said annular channel, and a disc fixedly mounted to said first tube, said disc having at least one formed therein communicating with said annular channel and leading to said means for receiving the adhesive of said rotatable assembly.

6. The apparatus according to claim 5 wherein said rotatable assembly comprises a first part having a first and a second end mounted concentrically about said stationary assembly, and a second part having a first end fixedly connected to said second end of said first part and mounted concentrically about said stationary assembly, said second part extending along said stationary portion from said second end of said first part.

7. The apparatus according to claim 6 wherein said means for receiving the adhesive from said means for feeding comprises a receptacle formed in said second part near said first end, said disc being mounted on said first tube at a position near said first end, said disc being mounted directly above said receptacle so that as the adhesive exits from said at least one opening, it will fall into said receptacle.

8. The apparatus according to claim 7 wherein said receptacle is conically shaped.

9. The apparatus according to claim 8 wherein said means for applying a strip of adhesive onto a portion of a wrapping tape comprises a ring mounted between said first end of said second part and said second end of said first part, said ring having an opening formed on the circumference thereof, said second part of said rotatable assembly having an opening for the communication of said opening in said ring with the outside of said apparatus for applying the adhesive to a wrapping tape in contact with said opening.

10. The apparatus according to claim 2 wherein said first part is of stepped cylindrical shape, said second end of said first part having threads formed on the circumference thereof, and said second part is of part cylindrical and part conical shape, said first end of said second part having threads formed in the inner circumference thereof for mating engagement with the threads of said second end of said first part.

11. The apparatus according to claim 10 wherein said means for rotatably mounting said rotatable assembly on said stationary assembly comprises a shaft concentrically mounted about said stationary assembly for rotation relative thereto, said shaft having a first end connected to a cylindrical portion of said second part, and a second end extending from said second part in a direction away from said second part.

12. The apparatus according to claim 1 wherein said means for supplying glue or other adhesive to said rotatable assembly comprises drop-equipment positioned near said stationary assembly and above said means for receiving the adhesive, a liquid column of said adhesive having a first end connected to said drop-equipment, and a valve having a first and a second end, said liquid column having a second end connected to said first end of said valve, said second end of said valve connected to said means for feeding the adhesive.

13. The apparatus according to claim 1 further comprising means for rotatably mounting a roll of wrapping tape about said stationary assembly, said means for rotatably mounting the wrapping tape mounting said wrapping tape to rotate about an axis coextensive with the longitudinal axis of said stationary assembly.

14. The apparatus according to claim 13 wherein said rotatable assembly comprises means for guiding the wrapping tape from the roll, said means for guiding the wrapping tape guiding the wrapping tape past said means for applying a strip of the adhesive.

15. The apparatus according to claim 13 further comprising means mounted above said rotatable assembly for wrapping the wrapping tape onto the article and for sensing whether adhesive has been applied to the wrapping tape.

* * * * *